US007121924B2

(12) United States Patent
Fritz et al.

(10) Patent No.: US 7,121,924 B2
(45) Date of Patent: Oct. 17, 2006

(54) ABRASIVE ARTICLES, AND METHODS OF MAKING AND USING THE SAME

(75) Inventors: Peter Joseph Fritz, Minneapolis, MN (US); Richard Louis Fry, White Bear Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 182 days.

(21) Appl. No.: 10/828,119

(22) Filed: Apr. 20, 2004

(65) Prior Publication Data

US 2005/0233678 A1 Oct. 20, 2005

(51) Int. Cl.
*B24B 1/00* (2006.01)
*B24D 17/00* (2006.01)

(52) U.S. Cl. ..... 451/28; 451/490; 451/508; 451/539

(58) Field of Classification Search ..... 451/28, 451/490, 508–510, 527, 539
See application file for complete search history.

(56) References Cited

U.S. PATENT DOCUMENTS

| | | | | |
|---|---|---|---|---|
| 2,156,002 | A | | 4/1939 | Tinnerman |
| 2,958,593 | A | | 11/1960 | Hoover et al. |
| 3,082,582 | A | | 3/1963 | Jeske |
| 3,149,442 | A | | 9/1964 | MacKay, Jr. et al. |
| 3,169,899 | A | | 2/1965 | Steuber |
| 3,333,371 | A | | 8/1967 | Pratt et al. |
| 3,395,417 | A | * | 8/1968 | Matouka ..... 451/490 |
| 3,561,938 | A | | 2/1971 | Block et al. |
| 3,562,965 | A | | 2/1971 | Johnson et al. |
| 3,667,170 | A | | 6/1972 | MacKay, Jr. |
| 3,683,567 | A | | 8/1972 | Ali |
| 3,745,641 | A | | 7/1973 | Paolini |
| 4,015,371 | A | | 4/1977 | Grayston |
| 4,018,576 | A | | 4/1977 | Davis et al. |
| 4,227,350 | A | | 10/1980 | Fitzer |
| 4,245,438 | A | | 1/1981 | van Buren, Jr. |
| 4,314,827 | A | | 2/1982 | Leitheiser et al. |
| 4,331,453 | A | | 5/1982 | Dau et al. |
| 4,345,689 | A | | 8/1982 | Chierici |
| 4,427,471 | A | | 1/1984 | Chierici |
| 4,439,953 | A | | 4/1984 | Block et al. |
| 4,518,397 | A | | 5/1985 | Leitheiser et al. |
| 4,551,189 | A | | 11/1985 | Peterson |
| 4,552,612 | A | | 11/1985 | Fortuna et al. |
| 4,575,987 | A | | 3/1986 | Fortuna |
| 4,588,419 | A | | 5/1986 | Caul et al. |
| 4,599,768 | A | | 7/1986 | Doyle et al. |
| 4,609,380 | A | | 9/1986 | Barnett et al. |
| 4,623,364 | A | | 11/1986 | Cottringer et al. |
| 4,652,275 | A | | 3/1987 | Bloecher et al. |
| 4,734,104 | A | | 3/1988 | Broberg |
| 4,737,163 | A | | 4/1988 | Larkey |
| 4,744,802 | A | | 5/1988 | Schwabel |
| 4,751,137 | A | | 6/1988 | Halg et al. |
| 4,770,671 | A | | 9/1988 | Monroe et al. |
| 4,778,702 | A | | 10/1988 | Hutter, III |
| 4,799,939 | A | | 1/1989 | Bloecher et al. |

(Continued)

FOREIGN PATENT DOCUMENTS

| | | |
|---|---|---|
| DE | 126325 | 7/1977 |

(Continued)

*Primary Examiner*—Hadi Shakeri

(57) ABSTRACT

An attachable abrasive article comprises an abrasive member having an attachment device affixed thereto. The attachment device comprises a fastener having a flange thereon. Thermoplastic material is disposed between the flange and the abrasive article. The disclosure also concerns methods of making and using attachable abrasive articles.

37 Claims, 3 Drawing Sheets

U.S. PATENT DOCUMENTS 4,842,912 A * 6/1989 Hutter, III ..... 428/66.6
4,881,951 A 11/1989 Wood et al.
4,927,431 A 5/1990 Buchanan et al.
4,987,714 A 1/1991 Lemke
4,991,362 A 2/1991 Heyer et al.
5,011,508 A 4/1991 Wald et al.
5,049,274 A 9/1991 Leason et al.
5,078,753 A 1/1992 Broberg et al.
5,090,968 A 2/1992 Pellow
5,108,463 A 4/1992 Buchanan et al.
5,137,542 A 8/1992 Buchanan et al.
5,139,978 A 8/1992 Wood
5,152,917 A 10/1992 Pieper et al.
5,201,916 A 4/1993 Berg et al.
5,203,884 A 4/1993 Buchanan et al.
5,227,104 A 7/1993 Bauer
5,316,812 A 5/1994 Stout et al.
5,328,716 A 7/1994 Buchanan
5,339,571 A 8/1994 Timmons et al.
5,366,523 A 11/1994 Rowenhorst et al.
5,378,251 A 1/1995 Culler et al.
5,417,726 A 5/1995 Stout et al.
5,429,647 A 7/1995 Larmie
5,436,063 A 7/1995 Follett et al.
5,490,878 A 2/1996 Peterson et al.
5,492,550 A 2/1996 Krishnan et al.
5,496,386 A 3/1996 Broberg et al.
5,498,269 A 3/1996 Larmie
5,520,711 A 5/1996 Helmin
5,549,962 A 8/1996 Holmes et al.
5,551,963 A 9/1996 Larmie
5,554,068 A 9/1996 Carr et al.
5,556,437 A 9/1996 Lee et al.
5,560,753 A 10/1996 Buchanan et al.
5,573,619 A 11/1996 Benedict et al.
5,591,239 A 1/1997 Larson et al.
5,595,578 A 1/1997 Stubbs et al.
5,609,706 A 3/1997 Benedict et al.
5,672,186 A 9/1997 Chesley et al.
5,681,361 A 10/1997 Sanders
5,700,302 A 12/1997 Stoetzel et al.
5,712,210 A 1/1998 Windisch et al.
5,713,706 A 2/1998 Lozano
5,718,366 A 2/1998 Colligan
5,858,140 A 1/1999 Berger et al.
5,928,070 A 7/1999 Lux
5,931,729 A 8/1999 Penttila et al.
5,942,015 A 8/1999 Culler et al.
5,951,389 A 9/1999 Hettes et al.
5,954,844 A 9/1999 Law et al.
5,961,674 A 10/1999 Gagliardi et al.
5,975,988 A 11/1999 Christianson
5,983,434 A 11/1999 Eichinger et al.
6,017,831 A 1/2000 Beardsley et al.
6,059,850 A 5/2000 Lise et al.
6,095,910 A 8/2000 Luedeke
6,145,730 A 11/2000 Wiesemann
6,207,246 B1 3/2001 Moren et al.
6,261,156 B1 7/2001 Johnson et al.
6,261,682 B1 7/2001 Law
6,302,930 B1 10/2001 Lux
6,609,951 B1 8/2003 Bates et al.
2001/0049259 A1 12/2001 Smith
2002/0065031 A1 5/2002 Chou et al.
2002/0081952 A1 6/2002 Fritz et al.
2002/0177391 A1 11/2002 Fritz et al.
2003/0097566 A1 5/2003 Fritz et al.
2003/0114078 A1 6/2003 Mann
2003/0114096 A1 6/2003 Fritz et al.
2003/0166385 A1 9/2003 Nelson

FOREIGN PATENT DOCUMENTS

FR 2494833 5/1982
GB 2334469 8/1999

* cited by examiner

ABRASIVE ARTICLES, AND METHODS OF MAKING AND USING THE SAME

BACKGROUND

Many abrasive articles are used in conjunction with tools having a rotatable shaft. Examples of such abrasive articles include coated abrasive articles, surface conditioning articles, and abrasive brushes. Generally, the abrasive articles are attached to the rotatable shaft by one or more fastening devices (i.e., fasteners) affixed to the abrasive article. In order to remain affixed to the abrasive article during use the fasteners must be strongly adhered to the abrasive articles.

While there are many known methods for affixing fasteners, particularly metal fasteners, improvements are always desired, especially when the complexity or cost can be reduced.

SUMMARY

In one aspect, the present invention relates to an attachable abrasive article comprising an abrasive member having an attachment device affixed thereto, the attachment device comprising:

a fastener having a flange thereon, wherein the flange has first and second major surfaces and a peripheral edge, and thermoplastic material having at least a portion thereof disposed between and affixed to the abrasive article and the first major surface of the flange, wherein the thermoplastic material contacts at least a portion of the first and second major surfaces of the flange, and wherein the attachment device comprises a material different than the thermoplastic material.

In another aspect, the present invention relates to a method of making an attachable abrasive article, the method comprising:

providing an abrasive member; and affixing an attachment device to the abrasive member, the attachment device comprising a fastener having a flange thereon and thermoplastic material having at least a portion thereof disposed between and affixed to the first major surface of the flange and the abrasive member, wherein the thermoplastic material contacts at least a portion of the second major surface of the flange, and wherein the attachment device is made of a material different than said thermoplastic material.

In another aspect, the present invention relates to a method of abrading a surface, the method comprising:

providing a tool having a rotatable shaft with an attachable abrasive article attached thereto, the attachable abrasive article comprising an abrasive member having an attachment device affixed thereto, the attachment device comprising a fastener having a flange thereon having first and second major surfaces and a peripheral edge, and thermoplastic material having at least a portion thereof disposed between and affixed to at least a portion of the first major surface of the flange and the abrasive article, wherein the attachment device comprises a material different than the thermoplastic material, and wherein the abrasive member is attached to the rotatable shaft via the attachment device;

frictionally contacting at least a portion of abrasive layer with a surface of a workpiece; and rotating the shaft such that the coated abrasive article rotates and abrades a portion of the surface.

In some embodiments, the abrasive member comprises a coated abrasive member, a surface conditioning member, or an abrasive brush member.

Fasteners may be affixed to abrasive members according to the present invention by processes that typically achieve a high degree of adhesion between the fastener and abrasive member without the need for thermosetting adhesives that typically result in aesthetically unattractive adhesive residue adjacent to the fastener. Further, methods according to the present invention are useful for bonding metal fasteners to non-metallic surfaces abrasive articles, and may, in some cases, provide stronger bonds between metallic fasteners and abrasive articles than achieved by current abrasives industry practice.

DETAILED DESCRIPTION

The present invention provides an abrasive article having an attachment device affixed thereto. The abrasive article may be any abrasive article to which an attachment device may be attached including, for example, coated abrasive articles, surface conditioning articles, and abrasive brushes.

In general, coated abrasive articles have abrasive particles secured to a backing. More typically, coated abrasive articles comprise a backing having two major opposed surfaces and an abrasive layer secured to a major surface. The abrasive layer is typically comprised of abrasive particles and a binder resin, wherein the binder resin serves to secure the abrasive particles to the backing.

Suitable abrasive particles include any abrasive particles known in the abrasive art. Exemplary useful abrasive particles include fused aluminum oxide based materials such as aluminum oxide, ceramic aluminum oxide (which may include one or more metal oxide modifiers and/or seeding or nucleating agents), and heat-treated aluminum oxide, silicon carbide, co-fused alumina-zirconia, diamond, ceria, titanium diboride, cubic boron nitride, boron carbide, garnet, flint, emery, sol-gel derived abrasive particles, and blends thereof. Preferably, the abrasive particles comprise fused aluminum oxide, heat-treated aluminum oxide, ceramic aluminum oxide, silicon carbide, alumina zirconia, garnet, diamond, cubic boron nitride, sol-gel derived abrasive particles, precisely shaped abrasive particles, agglomerate abrasive particles, or mixtures thereof.

The abrasive particles may be in the form of, for example, individual particles, abrasive composite particles, agglomerates (including erodible agglomerates), and mixtures thereof (e.g., having the same or different size and/or composition).

The abrasive particles typically have an average diameter of from about 0.1 to about 2000 micrometers, more preferably from about 1 to about 1300 micrometers, although other particles having other diameters can be used.

The backing may comprise a film, foam, fabric, sponge, or a combination thereof. Useful fabrics include woven and nonwoven fabrics, optionally having a treatment (e.g., a presize) thereon.

Coating weights for the abrasive particles may depend on, for example, the type of abrasive article (e.g., coated abrasive article or nonwoven abrasive article), the process for applying the abrasive particles, and the size of the abrasive particles, but typically range from about 5 to about 1350 grams per square meter.

Figure 1A:
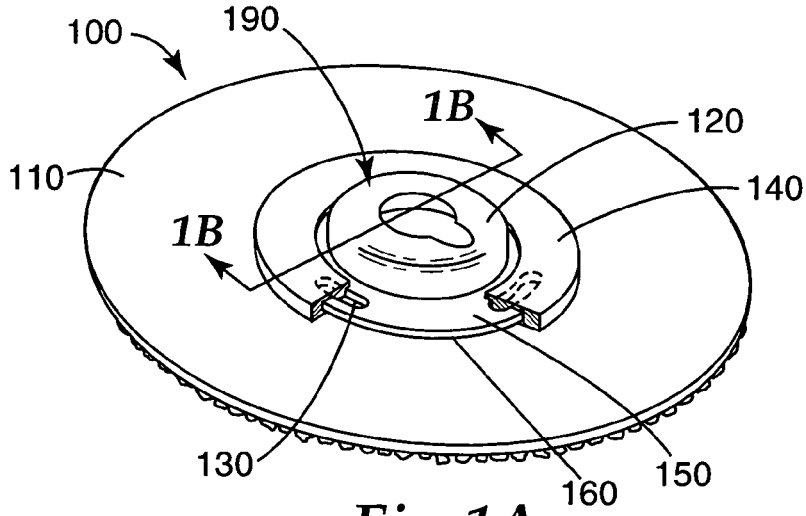
FIG. 1A is a perspective cut away view of an exemplary attachable coated abrasive article according to the present invention.
Figure 1B:
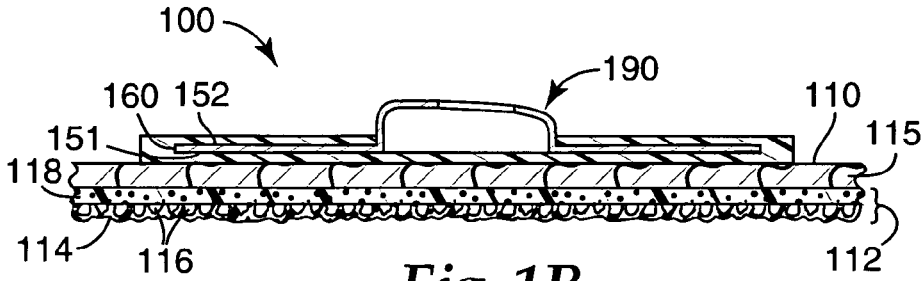
FIG. 1B is a cross-sectional side view of the attachable coated abrasive article of FIG. 1A.

In one embodiment of a coated abrasive article, the abrasive layer may comprise a make coat, optional size coat, and abrasive particles. Referring now to FIG. 1A, exemplary attachable coated abrasive article 100 has attachment device 190 affixed to coated abrasive disc 110. Attachment device 190 has a Tinnerman nut fastener 120 having thereon flange 150 with peripheral edge 160. Flange 150 has slots 130 extending therethrough and has thermoplastic cladding 140 thereon. As shown in FIG. 1B, coated abrasive disc 110 has backing 115 with abrasive layer 112 affixed thereto. Abrasive layer 112 has make layer 118 with abrasive particles 116 embedded therein and optional size layer 114 covering make layer 118 and particles 116. Flange 150 has first and second major surfaces 151 and 152, respectively. Thermoplastic cladding 140 is disposed between and affixed to coated abrasive disc 110 and first major surface 151. Thermoplastic cladding 140 also contacts peripheral edge 160, second major surface 152 and extends through slots 130 (as shown in FIG. 1A).

In making such a coated abrasive article, a make coat comprising a first binder resin precursor is applied to a major surface of the backing. Abrasive particles are then at least partially embedded into the make coat (e.g., by electrostatic coating), and the first binder resin precursor is at least partially cured to secure the particles to the make coat. If utilized, an optional size coat comprising a second binder resin precursor (which may be the same or different from the first binder resin precursor) is then applied over the make coat and abrasive particles, followed by curing the binder resin precursors.

Optionally, coated abrasive articles may further comprise, for example, a backsize (i.e., a coating on the major surface of the backing opposite the major surface having the abrasive coat), a presize or a tie layer (i.e., a coating between the abrasive coat and the major surface to which the abrasive coat is secured), and/or a saturant which coats both major surfaces of the backing. Coated abrasive articles may further comprise a supersize covering the abrasive coat. If present, the supersize typically includes grinding aids and/or anti-loading materials.

In another exemplary embodiment of a coated abrasive article according to the present invention, the abrasive layer has abrasive particles dispersed in a binder resin. In making such coated abrasive articles, a slurry comprising a first binder resin precursor and abrasive particles is typically applied to a major surface of the backing, and the binder resin precursor is then at least partially cured to form a binder resin. Optionally, a size coat may be present on the abrasive layer.

Figure 2:
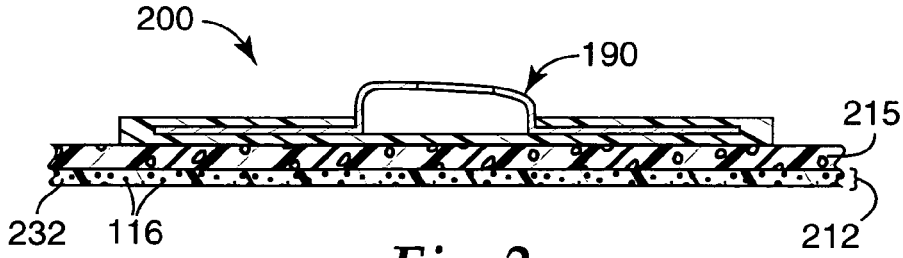
FIG. 2 is a cross-sectional side view of an exemplary attachable coated abrasive article according to the present invention.

Referring now to FIG. 2, exemplary attachable coated abrasive disc 200 has attachment device 190 affixed to coated abrasive disc 200. Coated abrasive disc 200 has foam backing 215 with abrasive layer 112 affixed thereto. Abrasive layer 112 has abrasive particles 116 dispersed in binder resin 232.

Further description of techniques and materials for making coated abrasive articles may be found in, for example, U.S. Pat. No. 4,314,827 (Leitheiser et al.); U.S. Pat. No. 4,518,397 (Leitheiser et al.); U.S. Pat. No. 4,588,419 (Caul et al.); U.S. Pat. No. 4,623,364 (Cottringer et al.); U.S. Pat. No. 4,652,275 (Bloecher et al.); U.S. Pat. No. 4,734,104 (Broberg); U.S. Pat. No. 4,737,163 (Larkey); U.S. Pat. No. 4,744,802 (Schwabel); U.S. Pat. No. 4,751,137 (Tumey et al.); U.S. Pat. No. 4,770,671 (Monroe et al.); U.S. Pat. No. 4,799,939 (Bloecher et al.); U.S. Pat. No. 4,881,951 (Wood et al.); U.S. Pat. No. 4,927,431 (Buchanan et al.); U.S. Pat. No. 5,498,269 (Larmie); U.S. Pat. No. 5,011,508 (Wald et al.); U.S. Pat. No. 5,078,753 (Broberg et al.); U.S. Pat. No. 5,090,968 (Pellow); U.S. Pat. No. 5,108,463 (Buchanan et al.); U.S. Pat. No. 5,137,542 (Buchanan et al.); U.S. Pat. No. 5,139,978 (Wood); U.S. Pat. No. 5,152,917 (Pieper et al.); U.S. Pat. No. 5,201,916 (Berg et al.); U.S. Pat. No. 5,203,884 (Buchanan et al.); U.S. Pat. No. 5,227,104 (Bauer); U.S. Pat. No. 5,328,716 (Buchanan); U.S. Pat. No. 5,366,523 (Rowenhorst et al.); U.S. Pat. No. 5,378,251 (Culler et al.); U.S. Pat. No. 5,417,726 (Stout et al.); U.S. Pat. No. 5,429,647 (Larmie); U.S. Pat. No. 5,436,063 (Follett et al.); U.S. Pat. No. 5,490,878 (Peterson et al.); U.S. Pat. No. 5,492,550 (Krishnan et al.); U.S. Pat. No. 5,496,386 (Broberg et al.); U.S. Pat. No. 5,520,711 (Helmin); U.S. Pat. No. 5,549,962 (Holmes et al.); U.S. Pat. No. 5,551,963 (Larmie); U.S. Pat. No. 5,556,437 (Lee et al.); U.S. Pat. No. 5,560,753 (Buchanan et al.); U.S. Pat. No. 5,573,619 (Benedict et al.); U.S. Pat. No. 5,609,706 (Benedict et al.); U.S. Pat. No. 5,672,186 (Chesley et al.); U.S. Pat. No. 5,700,302 (Stoetzel et al.); U.S. Pat. No. 5,942,015 (Culler et al.); U.S. Pat. No. 5,954,844 (Law et al.); U.S. Pat. No. 5,961,674 (Gagliardi et al.); U.S. Pat. No. 5,975,988 (Christianson); U.S. Pat. No. 6,059,850 (Lise et al.); and U.S. Pat. No. 6,261,682 (Law), the disclosures of which are incorporated herein by reference.

Surface conditioning articles are abrasive articles that typically include a porous (e.g., a lofty open porous) polymer filament structure having abrasive particles bonded thereto by a binder resin. An exemplary attachable surface conditioning article is shown in FIGS. 3A and 3B.

Figure 3A:
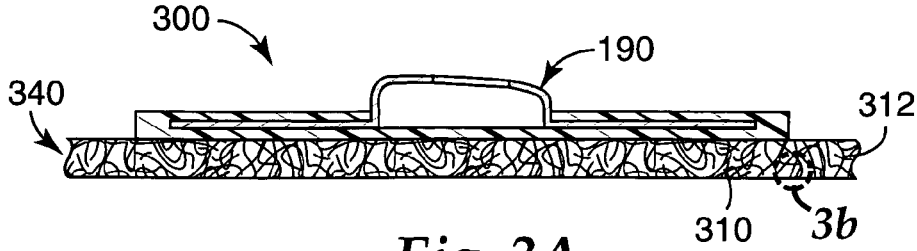
FIG. 3A is a cross-sectional side view of an exemplary attachable surface conditioning article according to the present invention.
Figure 3B:
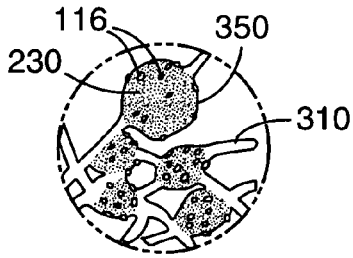
FIG. 3B is an enlarged view fibrous web 312 in FIG. 3A.

Referring now to FIG. 3A, attachable surface conditioning article 300 has attachment device 190 affixed to a surface conditioning article 340 having lofty open low-density fibrous web 312 formed of entangled filaments 310 impregnated with binder resin 230 (see FIG. 3B). Abrasive particles 116 are dispersed throughout fibrous web 312 on exposed surfaces of filaments 310. Binder resin 230 uniformly coats portions of filaments 310 and forms globules 350 which may encircle individual filaments 310 or bundles of filaments 310, and which adhere to the surface of the filaments 310 and/or collect at the intersection of contacting filaments 310, providing abrasive sites throughout the surface conditioning article.

The fiber web may comprise continuous filaments (e.g., a spunbond fiber web) and/or staple fibers that may be crimped and/or entangled with one another. Exemplary fibers include polyester fibers, polyamide fibers, and polyaramid fibers.

The fiber web may be reinforced with an optional scrim (e.g., a woven or nonwoven scrim), for example, by needle-tacking, stitchbonding, and/or adhesive bonding (e.g., using glue or a hot melt adhesive).

Further description of techniques and materials for making surface conditioning articles may be found in, for example, U.S. Pat. No. 2,958,593 (Hoover et al.); U.S. Pat. No. 4,018,575 (Davis et al.); U.S. Pat. No. 4,227,350 (Fitzer); U.S. Pat. No. 4,331,453 (Dau et al.); U.S. Pat. No. 4,609,380 (Barnett et al.); U.S. Pat. No. 4,991,362 (Heyer et al.); U.S. Pat. No. 5,554,068 (Carr et al.); U.S. Pat. No. 5,712,210 (Windisch et al.); U.S. Pat. No. 5,591,239 (Edblom et al.); U.S. Pat. No. 5,681,361 (Sanders); U.S. Pat. No. 5,858,140 (Berger et al.); U.S. Pat. No. 5,928,070 (Lux); U.S. Pat. No. 6,017,831 (Beardsley et al.); U.S. Pat. No. 6,207,246 (Moren et al.); and U.S. Pat. No. 6,302,930 (Lux), the disclosures of which are incorporated herein by reference.

Useful forms of attachable coated abrasive and surface conditioning articles according to the present invention include, for example, discs, pads, and sheets.

Figure 4:
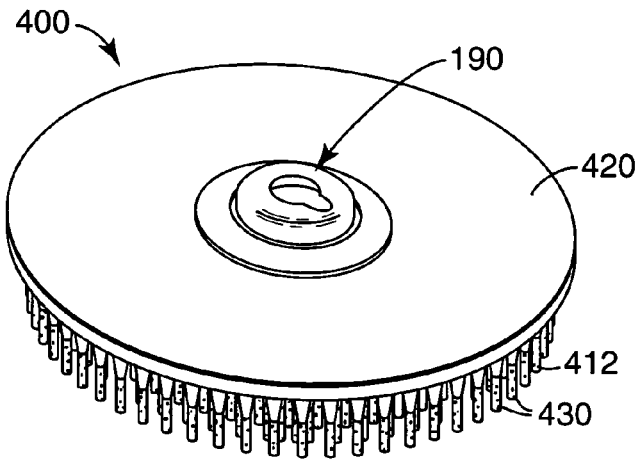
FIG. 4 is a perspective view of an exemplary attachable abrasive brush according to the present invention.

In another embodiment of the present invention, the attachable abrasive article may be an abrasive brush having an attachment device affixed thereto. An exemplary attachable abrasive brush is shown in FIG. 4. Referring to FIG. 4, abrasive right angle brush 400 has base 420 and abrasive bristles 430 affixed to base 420. Attachment device 190 is affixed to base 420. Individual abrasive bristles 430 have thereon abrasive layer 412, which has abrasive particles 116 (not shown) dispersed in binder resin 230 (not shown).

Exemplary attachable abrasive brushes that can be prepared according to the present invention include radial brushes, right angle brushes, cup brushes, and flap brushes. Further description of techniques and materials for making abrasive brushes may be found in, for example, U.S. Pat. No. 6,261,156B1 (Johnson et al.); U.S. Pat. No. 5,983,434 (Eichinger et al.); abrasive brushes such as flap brushes as described, for example, in U.S. Pat. No. 5,554,068 (Carr et al.), and unitary brushes as described, for example, in U.S. Pat. Publication 2002/0065031A1 (Chou et al.), published May 30, 2002, the disclosures of which are incorporated herein by reference.

The attachment device includes a fastener having a flange thereon, wherein the flange has a peripheral edge. The attachment device may comprise any dimensionally stable material. For example, the attachment device may comprise metal, plastic, reinforced plastic, ceramic, glass-ceramic, fiber composite, thermoset, wood, and combinations thereof.

The fastener may be any fastener known in the abrasive arts for fastening an abrasive article to a rotatable shaft, including quick change fasteners such as, for example, a "snap-on" fastener, a threaded post, a threaded recess (e.g., a threaded fastener nut as described in U.S. Pat. No. 4,245,438 (van Buren, Jr.)), a Tinnerman nut (e.g., as described in U.S. Pat. No. 2,156,002 (Tinnerman)), the disclosures of which patents are incorporated herein by reference.

Figure 5:
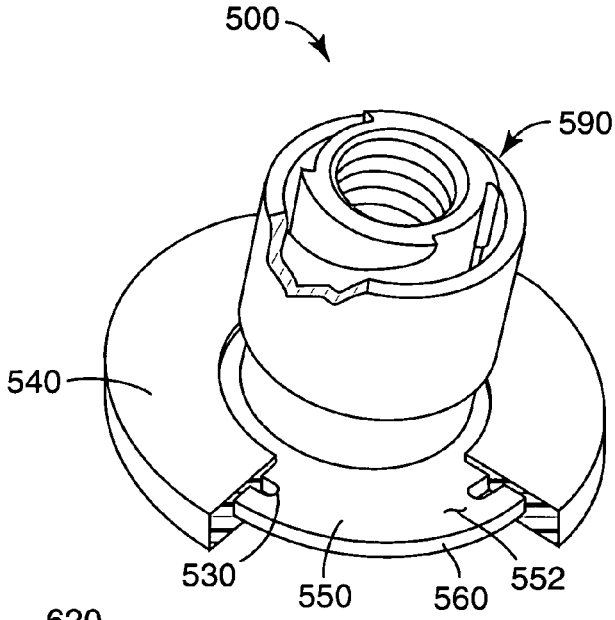
FIGS. 5–8 are perspective cut away views of exemplary thermoplastic coated fasteners useful in practice of the present invention.

For example, as shown in FIG. 5 exemplary attachment device 500 has threaded fastener nut 590 having flange 550 with peripheral edge 560. Flange 550 has slots 530 extending therethrough and has thermoplastic cladding 540 thereon. Flange 550 has first and second major surfaces 551 (not shown) and 552, respectively. Thermoplastic cladding 540 is affixed to first major surface 551 (not shown). Thermoplastic cladding 540 also contacts peripheral edge 560, second major surface 552 and extends through slots 530.

Figure 6:
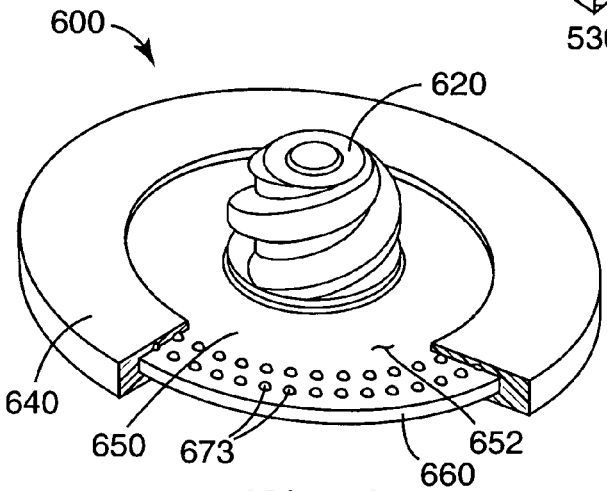

In another embodiment, shown in FIG. 6, exemplary attachment device 600 has threaded post fastener 620 having flange 650 with peripheral edge 660. Flange 650 has first and second major surfaces 651 (not shown) and 652, respectively. Flange 650 has embossed projections 673 extending from second major surface 652 and has thermoplastic cladding 640 thereon. Thermoplastic cladding 640 is affixed to first and second major surfaces 651 and 652. Thermoplastic cladding 640 also contacts peripheral edge 660.

Figure 7:
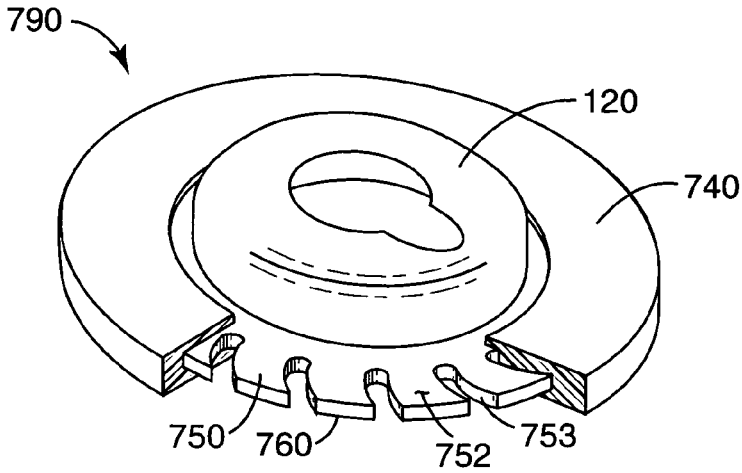

The flange may be circular, polygonal (e.g., hexagonal or octagonal), or another shape. The flange may be continuous or may have at least one discontinuity formed therein. The discontinuity may comprise a perforation, which may be circular, in the shape of a slit (e.g. linear or arcuate) or another shape. The discontinuity may have one or more angular edges, non-angular edges, or a combination thereof. The discontinuity may also comprise a slot or notch (e.g., a linear or arcuate slot or notch) extending inwardly from the peripheral edge of the flange. For example, as shown in FIG. 7, exemplary attachment device 790 has Tinnerman nut fastener 120 having flange 750 with peripheral edge 760. Flange 750 has first and second major surfaces 751 (not shown) and 752, respectively. Flange 750 has notches 753 extending inwardly from peripheral edge 760 of flange 750 and has thermoplastic cladding 740 thereon. Thermoplastic cladding 740 is affixed to first and second major surfaces 751 (not shown) and 752, and extends through notches 753. Thermoplastic cladding 740 also contacts peripheral edge 760.

The flange may have at least one embossed feature formed therein. For example, the flange may have pins, ribs, bumps, wells, troughs, or a combination thereof formed therein or thereon (e.g., as shown in FIG. 6, above). As used herein, the term "embossed feature" refers to a raised or depressed feature relative to at least one surface of the flange, and does not refer to method used to form the raised or depressed feature.

Thermoplastic material is disposed on at least a portion of the surface of the flange opposite the fastener, at least a portion of surface of the flange adjacent to the fastener, and optionally the peripheral edge of the flange. Preferably, the thermoplastic material contacts substantially all of the surface of the flange opposite the fastener, at least a portion of surface of the flange adjacent to the fastener, and optionally the peripheral edge of the flange.

After affixing the attachment means to an abrasive member, some of the thermoplastic material is disposed between, and affixed to, at least a portion of flange and the abrasive article.

Any thermoplastic material may be used as long as the attachment device does not consist of the same material. Typically, the thermoplastic is selected such that it adheres, preferably strongly adheres, to the abrasive article and preferably to the fastener, although if mechanically affixed to the fastener the thermoplastic need not adhere to the fastener. Useful thermoplastics include, for example, polyamides (e.g., polyhexamethyleneadipamide, polyhexamethylenesebacamide, polycaprolactam, and mixtures thereof), acrylics (e.g., copolymers of acrylic acid or methacrylic acid with alkyl acrylates), polycarbonates, polyurethanes, polyimides, polyesters (e.g., polyethylene terephthalate), polyolefins (e.g., polyethylene, polypropylene, and mixtures thereof), polyethers, and mixtures thereof.

The fastener is generally attached to the abrasive article by mechanically and/or adhesively affixing thermoplastic to the fastener, and subsequently bonding the thermoplastic to the abrasive article. Preferably, the thermoplastic forms a plate of sufficient size to at least substantially cover the surface of the flange bonded to the abrasive article, although the thermoplastic may have other forms such as, for example, a rod or block. The plate may be circular, polygonal, or any other shape, and may have protrusions such as for example pins, ribs, spring clips, or a combination thereof that may be adapted to engage the fastener.

Figure 8:
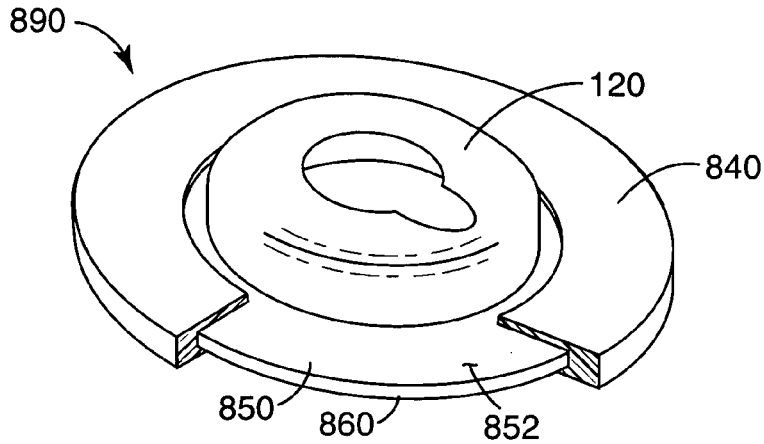

Suitable methods for affixing thermoplastic to the fastener include molten methods such as, for example, injection molding thermoplastic onto the fastener or at least partially immersing the fastener into molten thermoplastic. Referring now to FIG. 8, exemplary attachment device 890 comprises Tinnerman nut fastener 120 and flange 850 with cooled molten thermoplastic cladding 840 coated thereon. Flange 850 has first and second major surfaces 851 (not shown) and 852, respectively. Thermoplastic cladding 840 contacts first major surface 851 (not shown) of flange 850, peripheral edge 860, and radially outermost portion of second major surface 852.

Thermoplastic may be applied to the fastener by a variety of known methods including, for example, powder coating, injection molding, and immersion or dip coating in molten polymer or solution of polymer in a solvent. By applying thermoplastic to the fastener in the molten or dissolved state, secure bonding of the thermoplastic to the fastener is typically achieved. If applying molten thermoplastic to the fastener, the thermoplastic is preferably chosen such that, when cooled, it will form a strong adhesive bond to the fastener, especially if there is no mechanical engagement between the thermoplastic plate and the fastener. For example, thermoplastics comprising polyamide (e.g., nylon 6 or nylon 6,6), polyacrylate, polycarbonate, polyurethane, or a combination thereof typically strongly adhere to metallic substrates such as steel, iron, aluminum, titanium, and/or tin. Additionally, in such processes unwanted extraneous thermoplastic that is deposited onto the fastener may optionally be removed, for example, by abrasion or ablation.

Suitable methods for affixing thermoplastic to the fastener also include mechanical methods such as, for example, screws or snap on spring clips (e.g., integrally molded onto a thermoplastic disc), hot or cold rivets, and combinations thereof.

Figure 9:
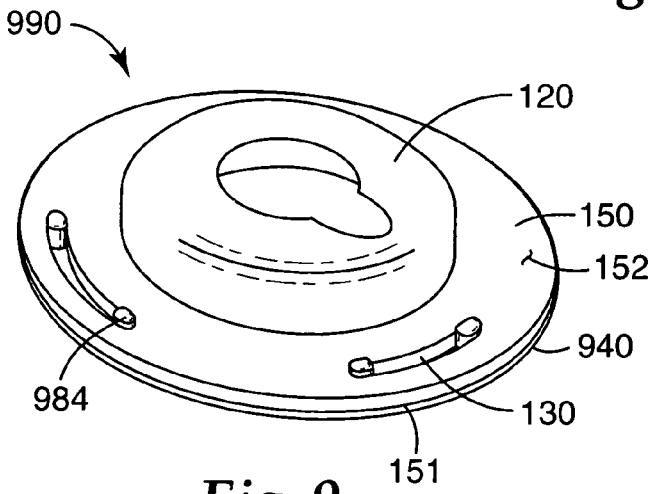
FIG. 9 is a perspective view of an exemplary thermoplastic coated fastener useful in practice of the present invention.

An exemplary embodiment of an attachment device having thermoplastic mechanically affixed to a fastener having a flange is shown in FIG. 9, wherein attachment device 990 comprises Tinnerman nut fastener 120 having thereon flange 150 with slots 130 therein. Thermoplastic plate 940 is affixed to first major surface 151 of flange 150 by spring clips 984 which extend from thermoplastic plate 940 through slots 130 and contact second major surface 152 of flange 150.

The attachment device is typically attached to the abrasive article by one or more welding techniques in which the thermoplastic is heated until it becomes at least partially softened or molten, and then cooled while in contact with the abrasive article, thereby forming an adhesive and optionally mechanical bond. Suitable techniques known in the thermoplastic welding art include, for example, ultrasonic welding, infrared welding, vibration welding, and frictional welding (including spin welding). Welding may also be accomplished as a stepwise process in which at least a portion of the thermoplastic is heated until it is at least partially softened or melted, and then the softened or melted thermoplastic is bonded to the abrasive article. Of the above-mentioned techniques, at least spin welding is typically simple, effective, and convenient.

The fastener may be attached to any portion of the abrasive article, although it is typically attached to a portion that is centrally located on an axis of rotational symmetry and not intended for abrading an article.

During abrading of a workpiece, attachable abrasive articles according to the present invention are typically used in combination with a tool having a rotatable shaft such as, for example, a grinder or an electric drill. Accordingly, the fastener portion of the attachment device is typically mounted on the rotatable shaft of the tool. To assist in attaching the attachable abrasive article to the rotatable shaft, the shaft may have a complementary fastener mounted thereon and adapted to engage the fastener on the attachment device.

Various modifications and alterations of this invention may be made by those skilled in the art without departing from the scope and spirit of this invention, and it should be understood that this invention is not to be unduly limited to the illustrative embodiments set forth herein.

What is claimed is:

1. An attachable abrasive article comprising an abrasive member selected from the group consisting of a coated abrasive member, a surface conditioning member, and an abrasive brush member, the abrasive member having an attachment device affixed thereto, wherein the attachment device comprises:

a fastener having a flange thereon, wherein the flange has first and second major surfaces and a peripheral edge, and wherein the flange has at least one discontinuity formed therein, the discontinuity selected from the group consisting of a perforation, a slot extending inwardly from the peripheral edge, and a notch extending inwardly from the peripheral edge; and thermoplastic material having at least a portion thereof disposed between and affixed to the abrasive member and the first major surface of the flange, wherein the thermoplastic material is welded to the abrasive member, wherein the thermoplastic material extends through said at least one discontinuity and contacts at least a portion of the first and second major surfaces of the flange, and wherein the fastener comprises a material different than the thermoplastic material.

2. An attachable abrasive article according to claim 1, wherein the thermoplastic material contacts substantially the entire first major surface of the flange and the peripheral edge.

3. An attachable abrasive article according to claim 1, wherein the thermoplastic material comprises a disc with spring clips integrally molded thereon.

4. An attachable abrasive article according to claim 1, wherein the discontinuity comprises a perforation.

5. An attachable abrasive article according to claim 1, wherein the discontinuity comprises a slot extending inwardly from the peripheral edge.

6. An attachable abrasive article according to claim 1, wherein the flange has at least one embossed feature formed therein.

7. An attachable abrasive article according to claim 1, wherein the flange comprises metal.

8. An attachable abrasive article according to claim 1, wherein the flange is circular.

9. An attachable abrasive article according to claim 1, wherein the fastener comprises a quick change fastener selected from the group consisting of a snap-on fastener, a threaded post, a threaded nut, and a Tinnerman nut.

10. An attachable abrasive article according to claim 1, wherein the fastener is selected from the group consisting of a Tinnerman nut and a threaded post.

11. An attachable abrasive article according to claim 1, wherein the thermoplastic material comprises polyamide.

12. An attachable abrasive article according to claim 1, wherein the abrasive member comprises a coated abrasive member, the coated abrasive member comprising:

a backing having first and second, opposed major surfaces; and an abrasive layer secured to at least a portion of the first major surface of the backing, wherein the attachment device is affixed to the second major surface of the backing.

13. An attachable abrasive article according to claim 12, wherein the backing comprises at least one of a foam or a sponge.

14. An attachable abrasive article according to claim 13, wherein the thermoplastic material contacts substantially the entire first major surface of the flange and the peripheral edge.

15. An attachable abrasive article according to claim 12, wherein the abrasive layer comprises a make layer having abrasive particles embedded therein and a size layer at least partially covering the make layer and abrasive particles.

16. An attachable abrasive article according to claim 12, wherein the fastener comprises a quick change fastener.

17. An attachable abrasive article according to claim 16, wherein the fastener is selected from the group consisting of a Tinnerman nut and a threaded post.

18. An attachable abrasive article according to claim 12, wherein the backing comprises fabric.

19. An attachable abrasive article according to claim 1, wherein the abrasive article comprises a surface conditioning member, the surface conditioning member having a lofty open low-density fibrous web formed of entangled filaments impregnated with binder resin, and abrasive particles dispersed throughout the fibrous web on exposed surfaces of the filaments, wherein the surface conditioning member has first and second opposed major surfaces, and wherein the attachment device is welded to the second major surface of the surface conditioning member.

20. An attachable abrasive article according to claim 19, wherein the thermoplastic material contacts substantially the entire first major surface of the flange and the peripheral edge.

21. An attachable abrasive article according to claim 19, wherein the fastener comprises a quick change fastener.

22. An attachable abrasive article according to claim 21, wherein the fastener is selected from the group consisting of a Tinnerman nut and a threaded post.

23. An attachable abrasive article according to claim 21, wherein the surface conditioning member comprises a lofty non-woven web secured to a scrim, and wherein the thermoplastic material contacts the scrim.

24. An attachable abrasive article according to claim 23, wherein the scrim is a woven scrim.

25. An attachable abrasive article according to claim 1, wherein the abrasive member comprises an abrasive brush member, the abrasive brush member comprising abrasive bristles affixed to a base, and wherein the attachment device is welded to the base.

26. An abrasive brush according to claim 25, wherein the abrasive bristles have an abrasive layer thereon.

27. A method of making an attachable abrasive article, the method comprising:

providing an abrasive member selected from the group consisting of a coated abrasive member, a surface conditioning member, and an abrasive brush member; and welding an attachment device to the abrasive member, the attachment device comprising a fastener having a flange thereon and thermoplastic material having at least a portion thereof disposed between and affixed to the first major surface of the flange and the abrasive member, wherein the flange has at least one discontinuity formed therein, the discontinuity selected from the group consisting of a perforation, a slot extending inwardly from the peripheral edge, and a notch extending inwardly from the peripheral edge, wherein the thermoplastic material extends through said at least one discontinuity and contacts at least a portion of the second major surface of the flange, and wherein the fastener is made of a material different than said thermoplastic material.

28. A method according to claim 27, wherein welding comprises spin welding.

29. A method according to claim 27, wherein the abrasive member comprises a coated abrasive member, the coated abrasive member method comprising:

a backing having first and second, opposed major surfaces;

an abrasive layer secured to at least a portion of the first major surface of the backing; and wherein the attachment device is affixed to at least a portion of the second major surface of the backing.

30. A method according to claim 29, wherein the abrasive member comprises a surface conditioning member, the surface conditioning member having a lofty open low-density fibrous web formed of entangled filaments impregnated with binder resin, and abrasive particles dispersed throughout the fibrous web on exposed surfaces of the filaments, wherein the surface conditioning member has first and second opposed major surfaces, and wherein the attachment device is affixed to the second major surface of the surface conditioning member.

31. A method according to claim 27, wherein the abrasive member comprises an abrasive brush member, the abrasive brush member comprising abrasive bristles affixed to a base, and wherein the attachment device is affixed to the base.

32. A method of abrading a surface, the method comprising:

providing a tool having a rotatable shaft with an attachable abrasive article attached thereto, the attachable abrasive article comprising an abrasive member selected from the group consisting of a coated abrasive member, a surface conditioning member, and an abrasive brush member, the abrasive member having an attachment device affixed thereto, the attachment device comprising: (a) a fastener having a flange thereon having first and second major surfaces and a peripheral edge, wherein the flange has at least one discontinuity formed therein, the discontinuity selected from the group consisting of a perforation, a slot extending inwardly from the peripheral edge, and a notch extending inwardly from the peripheral edge; and (b) thermoplastic material extending through said at least one discontinuity and having at least a portion thereof disposed between and affixed to at least a portion of the first major surface of the flange and the abrasive member, wherein the thermoplastic material is welded to the abrasive member, wherein the fastener comprises a material different than the thermoplastic material, and wherein the abrasive member is attached to the rotatable shaft via the attachment device;

frictionally contacting at least a portion of abrasive layer with a surface of a workpiece; and rotating the shaft such that the coated abrasive article rotates and abrades a portion of the surface.

33. A method according to claim 32, wherein the abrasive member comprises a coated abrasive member, the coated abrasive member comprising:

a backing having first and second, opposed major surfaces;

an abrasive layer secured to at least a portion of the first major surface of the backing; and wherein the attachment device is affixed to the second major surface of the backing.

34. A method according to claim 33, wherein the backing comprises at least one of foam or a sponge.

35. A method according to claim 33, wherein the backing comprises fabric.

36. A method according to claim 32, wherein the abrasive member comprises a surface conditioning member having a lofty open low-density fibrous web formed of entangled filaments impregnated with binder resin, and abrasive particles dispersed throughout the fibrous web on exposed surfaces of the filaments, the surface conditioning member further having first and second opposed major surfaces, wherein the attachment device is affixed to at least a portion of the second major surface of the surface conditioning member, and wherein the thermoplastic material contacts at least a portion of the second major surface of the surface conditioning member.

37. A method according to claim 32, wherein the abrasive member comprises an abrasive brush member, the abrasive brush member comprising abrasive bristles affixed to a base, and wherein the attachment device is affixed to the base.

* * * * *

UNITED STATES PATENT AND TRADEMARK OFFICE

CERTIFICATE OF CORRECTION

PATENT NO. : 7,121,924 B2
APPLICATION NO. : 10/828119
DATED : October 17, 2006
INVENTOR(S) : Peter J. Fritz It is certified that error appears in the above-identified patent and that said Letters Patent is hereby corrected as shown below:

Title Page item 56
Column 1 (U.S. Patent Documents), Line 9, delete "3,562,965 A" and insert -- 3,562,968 A -- in place thereof.
Column 2 (U.S. Patent Documents), Line 2, delete "4,018,576 A" and insert --4,018,575A -- in place thereof.

Signed and Sealed this

Ninth Day of January, 2007

JON W. DUDAS
*Director of the United States Patent and Trademark Office*

UNITED STATES PATENT AND TRADEMARK OFFICE

CERTIFICATE OF CORRECTION

PATENT NO. : 7,121,924 B2
APPLICATION NO. : 10/828119
DATED : October 17, 2006
INVENTOR(S) : Peter J. Fritz It is certified that error appears in the above-identified patent and that said Letters Patent is hereby corrected as shown below:

On the title page, item [56]:

Column 1 (U.S. Patent Documents), Line 9, delete "3,562,965 A" and insert -- 3,562,968 A -- in place thereof.
Column 2 (U.S. Patent Documents), Line 2, delete "4,018,576 A" and insert -- 4,018,575 A -- in place thereof.

Signed and Sealed this

Thirtieth Day of January, 2007

JON W. DUDAS
*Director of the United States Patent and Trademark Office*